US008167779B2

(12) United States Patent
Chiu

(10) Patent No.: US 8,167,779 B2
(45) Date of Patent: May 1, 2012

(54) FULL BODY TWISTING EXERCISE MACHINE

(75) Inventor: Ciber Chiu, Lugang Township (TW)

(73) Assignee: Famosa Corp., Lugang Township, Changhua County (TW)

( * ) Notice: Subject to any disclaimer, the term of this patent is extended or adjusted under 35 U.S.C. 154(b) by 160 days.

(21) Appl. No.: 12/625,539

(22) Filed: Nov. 24, 2009

(65) Prior Publication Data

US 2011/0124475 A1 May 26, 2011

(51) Int. Cl.
*A63B 21/22* (2006.01)

(52) U.S. Cl. ..... 482/110; 482/148

(58) Field of Classification Search ..... 482/51–53, 482/57–65, 110, 148, 146, 147
See application file for complete search history.

(56) References Cited

U.S. PATENT DOCUMENTS 2,387,966 A * 10/1945 Gustaf ..... 482/92
4,673,177 A * 6/1987 Szymski ..... 482/64
5,016,870 A * 5/1991 Bulloch et al. ..... 482/62
5,039,091 A * 8/1991 Johnson ..... 482/64
5,050,871 A * 9/1991 Douglas et al. ..... 482/110
5,766,115 A * 6/1998 Huang ..... 482/110
6,719,675 B2 * 4/2004 Yu ..... 482/110
7,491,158 B1 * 2/2009 Danaei-Boroumand ..... 482/110
7,713,178 B2 * 5/2010 Edmondson ..... 482/70
2009/0156377 A1 * 6/2009 Brown ..... 482/110

* cited by examiner

*Primary Examiner* — Stephen Crow

(57) ABSTRACT

A full body twisting exercise machine has a support frame comprising a lower layer portion and an upper layer portion, a bearing respectively installed at the lower and the upper layer portions, a revolving shaft disposed though both bearings, one end of the revolving shaft protruding from the upper layer portion and connected to a crank and having an extension bar, a free end of the extension bar having a connecting portion; a connecting rod, a driving rod and a handle, an aperture of the connecting rod pivoted to the connecting portion of the extension bar and secured to one end of the driving rod; another end of the driving rod connected to a handle; and a flywheel disposed between the lower layer portion and the upper layer portion and jacketing the revolving shaft, and the lower layer portion of the support frame having a damping device.

11 Claims, 13 Drawing Sheets

FULL BODY TWISTING EXERCISE MACHINE

BACKGROUND OF THE INVENTION

1. Field of the Invention

The present invention relates to a body exercise machine, and more particularly to a full body twisting exercise machine.

2. Description of the Related Art

Currently, a prior art body twisting exercise machine, with reference to FIG. 13, comprises a base 40 having a motor 41 and a transmission gear set 42. A first revolving rod 51 and a second revolving rod 61 are capable of rotating in the same direction; a vertical tube 43 jackets the first revolving rod 51. A first rotation device 50 is disposed at a front portion of the base 40 and includes the revolving rod 51. The revolving rod 51 has an extendable rod 52, and the upper end of the extendable rod 52 is jacked with a rotatable connecting rod 53, with the connecting rod 53 connected to an inclined T-shaped push bar 54. The push bar 54 has two handles 541 at its two ends. A second rotation device 60 is disposed at a rear portion of the base 40 and has a second revolving rod 61. The second revolving rod 61 is lower than the first revolving rod 51. A horizontal elbow pipe 611 is jacketed with an extendable rotating arm 62; a rotatable plate 63 is placed on the rotating arm 62, and a wheel 4 is disposed below the rotating arm 62. With the above-mentioned structure, a user can stand on the rotatable plate 63 and holds the two handles 541 of the push bar 54; the rotational movement of the revolving rod 61 causes the rotating arm 62 and the rotatable plate 63 to rotate in reciprocating movement, which provides a body twisting exercise for the user.

However, the prior art machine has the following drawbacks:

1. The first and second rotation devices 50, 60 are driven by a motor 41, while the transmission gear set 42 generates the rotational direction and controls rotation speed. However, the motor 41 is unable to provide sufficient rotational resistance for exercise efficacy. In addition, the rotatable plate 63 carries a heavier weight than the handle 541, such that it is difficult for the motor to properly transfer momentum to the front portion and the rear portion, and the operational movement is not very smooth.

2. The motor 41, the transmission gear set 42 and the two revolving rods 51, 61 are all connected by gears, and since during the operations the motor 41 is loaded with the weight of the user, the gaps between the teeth of the gears create noise.

3. When the user wants to stop exercising, the motor 41 continues to drive the rotatable plate 63 and the handle 541, or after turning off power to the motor, the rotation mechanism continues operating due to momentum, which may cause the user to be accidentally injured.

Therefore, it is desirable to provide a full body twisting exercise machine to mitigate and/or obviate the aforementioned problems.

SUMMARY OF THE INVENTION

An objective of the present invention is to provide a full body twisting exercise machine which can provide more efficient exercise effect.

In order to achieve the above-mentioned objectives a full body twisting exercise machine comprises a support frame, a control set and a flywheel. The support frame comprises a lower layer portion and an upper layer portion; bearings are respectively installed at the lower and the upper layer portions. A revolving shaft is vertically disposed though both bearings. The support frame further comprises a middle layer portion between the lower and the upper layer portions, and a bearing is installed at the middle layer portion and jackets the revolving shaft to increase the rotational stability of the revolving shaft. One end of the revolving shaft protrudes from the upper layer portion and is connected to a crank. The crank further comprises an extension bar inserted thereof and a positioning knob at an end, and the extension bar provides a plurality of adjustment apertures providing different positions for the positioning knob. A free end of the extension bar has a connecting portion. In addition, the bottom side of the lower layer portion of the support frame further comprises a base board. The control set comprises a connecting rod, a driving rod and a handle. An aperture of the connecting rod is pivoted to the connecting portion of the extension bar and is secured to one end of the driving rod. The connecting rod and the driving rod are locked together with a screw, a corresponding tap and a nut, and a gap between the connecting rod and the driving rod is adjustable with a threaded portion and secured with the nut. Another end of the driving rod is connected to a handle. The driving rod further comprises an adjusting block at an end, and the adjusting block includes a positioning aperture for accepting the handle. The handle is T-shaped and has an extension connecting tube inserted into the positioning aperture of the adjusting block. The connecting tube of the handle has a plurality of through holes and an adjusting knob is secured onto the adjusting block, such that the adjusting knob is locked with a through hole to secure the handle and the adjusting block to provide different heights for the handle by insertion into different through holes. The driving rod and the crank are parallel to each other. Also, the upper layer portion is connected to an auxiliary arm and a brace. The auxiliary arm is bent above the control set and one free end of the auxiliary arm is connected to a cable attached to a securing member by the other end, and the securing member is secured onto the driving rod. The brace is pivotably coupled to the upper layer portion of the support frame, and the brace has a notch adapted to engage with a corresponding protrusion on the upper layer portion. The brace is used to support the driving rod. The flywheel is disposed between the lower layer portion and the upper layer portion of the support frame and jackets the revolving shaft. A one way bearing is installed at a connection point of the flywheel and the revolving shaft. The lower layer portion of the support frame further has a damping device. The damping device utilizes at least one lining that engages with an outer edge of the flywheel, and the damping device is connected to a control button for adjusting a pressure of the lining against the outer edge of the flywheel. By pushing the handle to generate a twisting movement, the driving rod drives the revolving shaft and the flywheel to simultaneously rotate, and the flywheel and the damping device provide resistance for exercise purposes.

With the above-mentioned structure, following benefits may be realized: 1. Embodiments of the present invention utilize the control set, the crank and the revolving shaft to provide an upper body twisting exercise, and the flywheel and the damping device increase and adjust the resistance. In addition, the momentum of the flywheel makes the operational movement more smooth. 2. Embodiments of the present invention need only utilize the connecting rod pivoted to the extension bar of the crank to provide an exercise effect with a direct linkage; therefore, the operational movement can be performed silently. 3. The one-way bearing is installed between the flywheel and the revolving shaft, such that the flywheel can only be driven by the control set is unable to drive the control set in a reversed direction.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
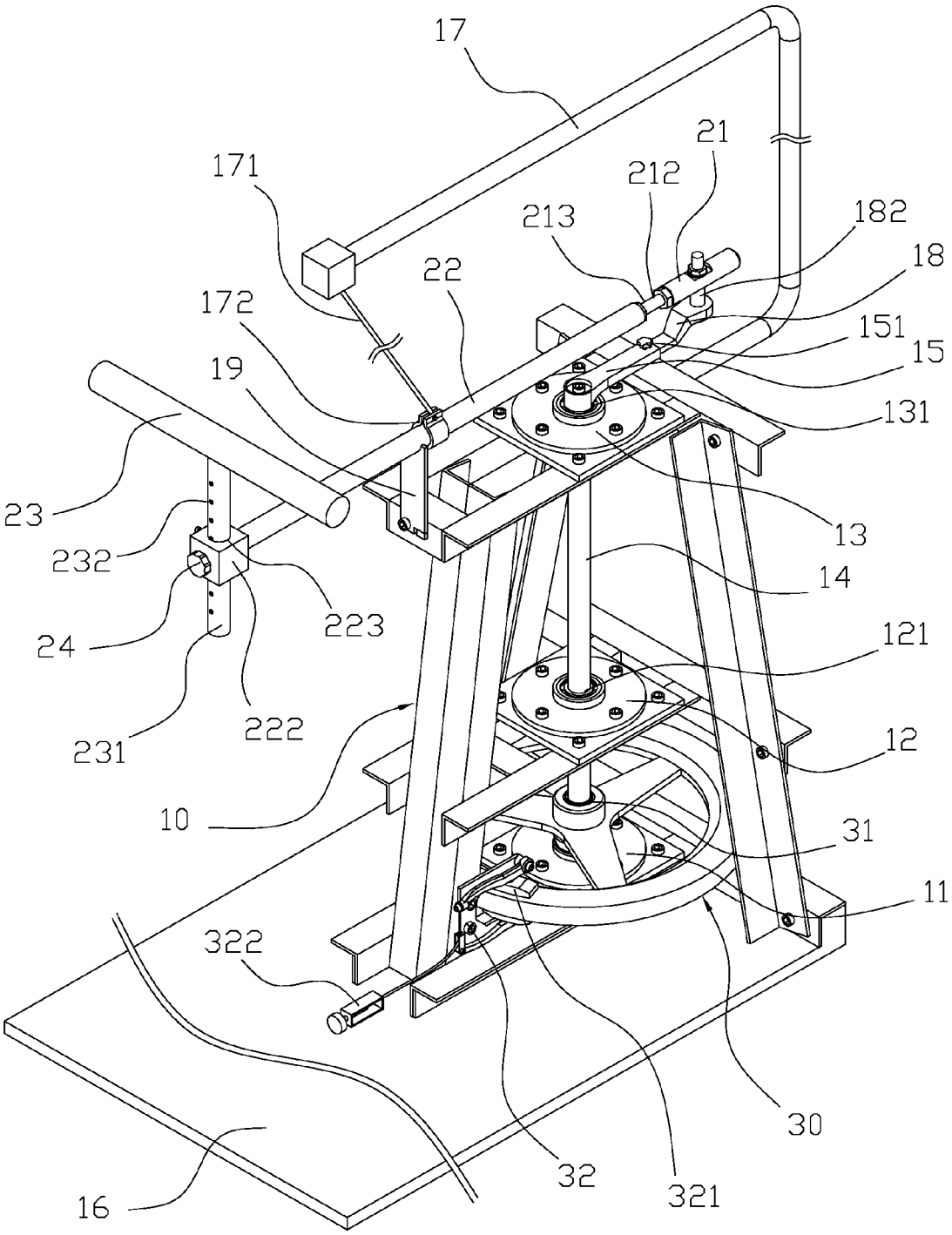
FIG. 1 is a perspective assembly view of an embodiment of the present invention.
Figure 2:
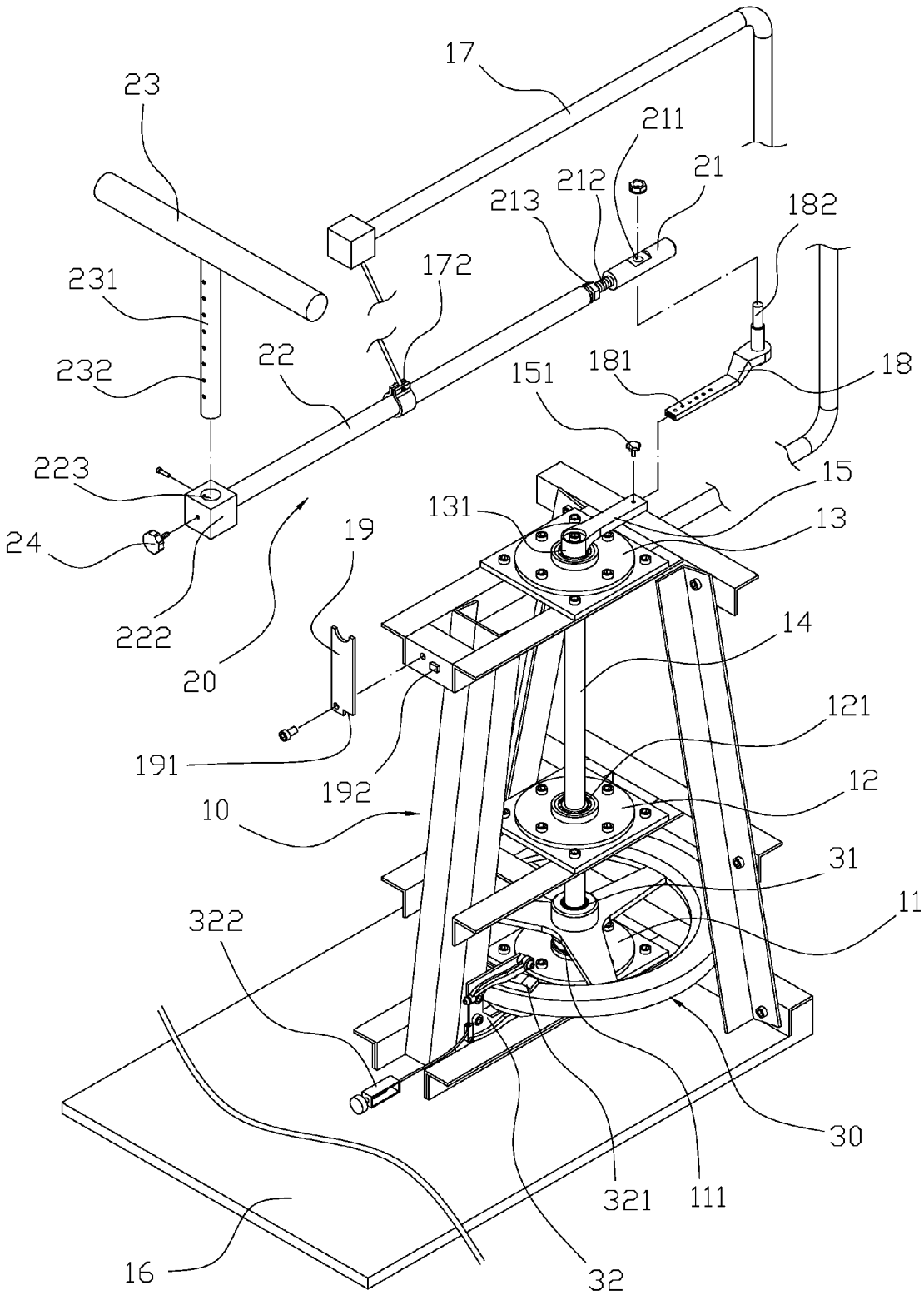
FIG. 2 is a perspective exploded assembly view according to the present invention.
Figure 3:
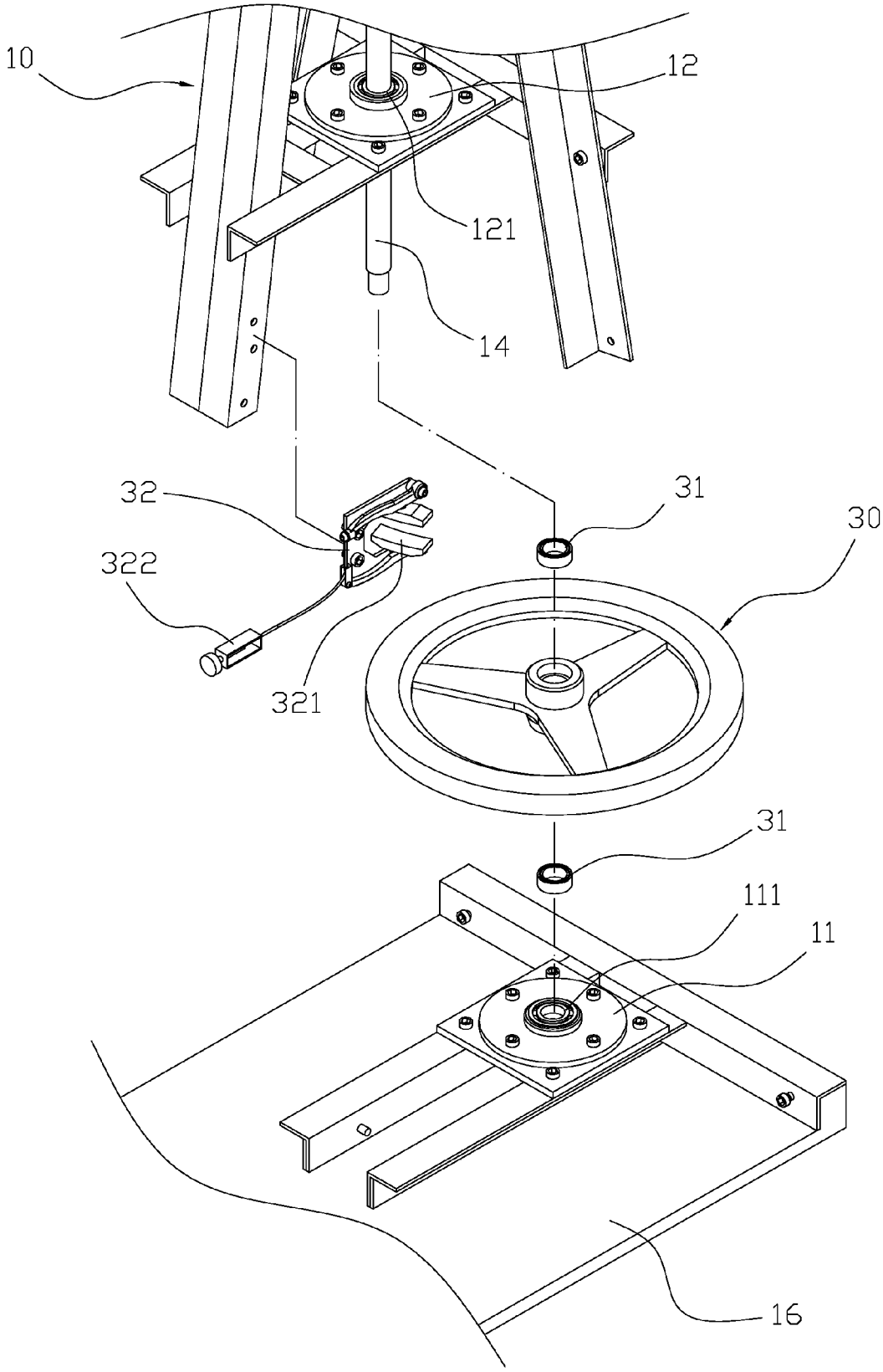
FIG. 3 is a detailed perspective exploded assembly view around a support frame according to an embodiment of the present invention.

Please refer to FIG. 1, FIG. 2 and FIG. 3. A full body twisting exercise machine comprises a support frame 10, a control set 20 and a flywheel 30. The support frame 10 comprises a lower layer portion 11 and an upper layer portion 13; bearings 111, 131 are respectively installed at the lower and the upper layer portions 11, 13. A revolving shaft 14 is vertically disposed though both bearings 111, 131. The support frame 10 further comprises a middle layer portion 12 between the lower and the upper layer portions 11, 13, and a bearing 121 is installed at the middle layer portion 12 and jackets the revolving shaft 14 to increase the rotational stability of the revolving shaft 14. One end of the revolving shaft 14 protrudes from the upper layer portion 13 and is connected to a crank 15. The crank 15 further comprises an extension bar 18 inserted thereof and a positioning knob 151 at an end, and the extension bar 18 provides a plurality of adjustment apertures 181 providing different positions for the positioning knob 151. A free end of the extension bar 18 has a connecting portion 182. In addition, the bottom side of the lower layer portion 11 of the support frame 10 further comprises a base board 16. The control set 20 comprises a connecting rod 21, a driving rod 22 and a handle 23. An aperture 211 of the connecting rod 21 is pivoted to the connecting portion 182 of the extension bar 18 and is secured to one end of the driving rod 22. The connecting rod 21 and the driving rod 22 are locked together with a screw 212, a corresponding tap 221 and a nut 213, and a gap between the connecting rod 21 and the driving rod 22 is adjustable with a threaded portion and secured with the nut 213. Another end of the driving rod 22 is connected to a handle 23. The driving rod 22 further comprises an adjusting block 222 at an end, and the adjusting block 222 includes a positioning aperture 223 for accepting the handle 23. The handle 23 is T-shaped and has an extension connecting tube 231 inserted into the positioning aperture 223 of the adjusting block 22. The connecting tube 231 of the handle 23 has a plurality of through holes 232 and an adjusting knob 24 is secured onto the adjusting block 222, such that the adjusting knob 24 is locked with a through hole 231 to secure the handle 23 and the adjusting block 24 to provide different heights for the handle 23 by insertion into different through holes 232. The driving rod 22 and the crank 15 are parallel to each other. Also, the upper layer portion 13 is connected to an auxiliary arm 17 and a brace 19. The auxiliary arm 17 is bent above the control set 20 and one free end of the auxiliary arm 17 is connected to a cable 171 attached to a securing member 172 by the other end, and the securing member 172 is secured onto the driving rod 22. The brace 19 is pivotably coupled to the upper layer portion 13 of the support frame 10, and the brace has a notch 191 adapted to engage with a corresponding protrusion 192 on the upper layer portion 13. The brace 19 is used to support the driving rod 22. The flywheel 30 is disposed between the lower layer portion 11 and the upper layer portion 13 of the support frame 10 and jackets the revolving shaft 14. A one way bearing 31 is installed at a connection point of the flywheel 30 and the revolving shaft 14. The lower layer portion 11 of the support frame 10 further has a damping device 32. The damping device 32 utilizes at least one lining 321 that engages with an outer edge of the flywheel 30, and the damping device 32 is connected to a control button 322 for adjusting a pressure of the lining 321 against the outer edge of the flywheel 30. By pushing the handle 23 to generate a twisting movement, the driving rod 22 drives the revolving shaft 14 and the flywheel 30 to simultaneously rotate, and the flywheel 30 and the damping device 32 provide resistance for exercise purposes.

Figure 4:
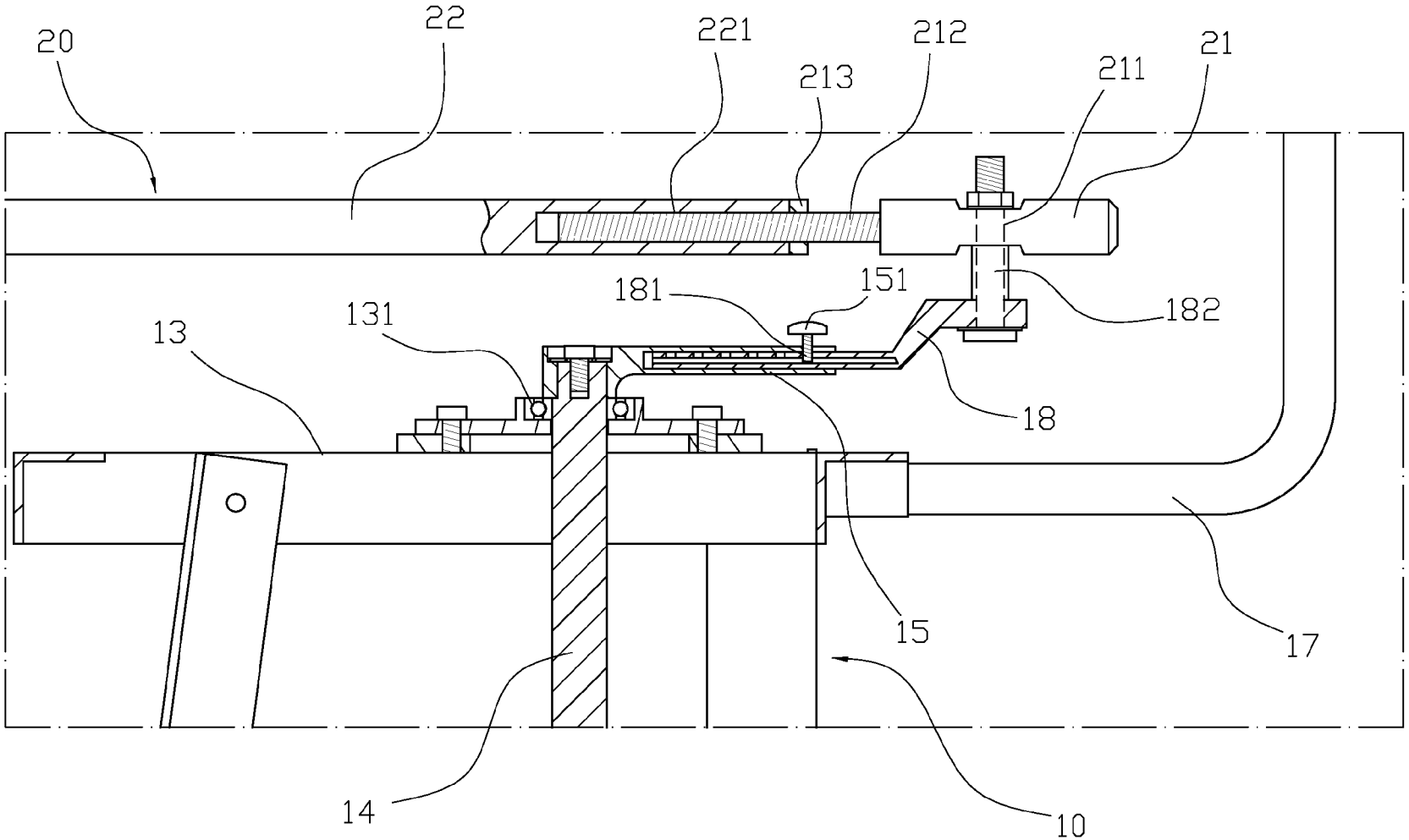
FIG. 4 is a detailed cross-sectional view of a connection between a connecting rod and a crank according to an embodiment of the present invention.
Figure 5:
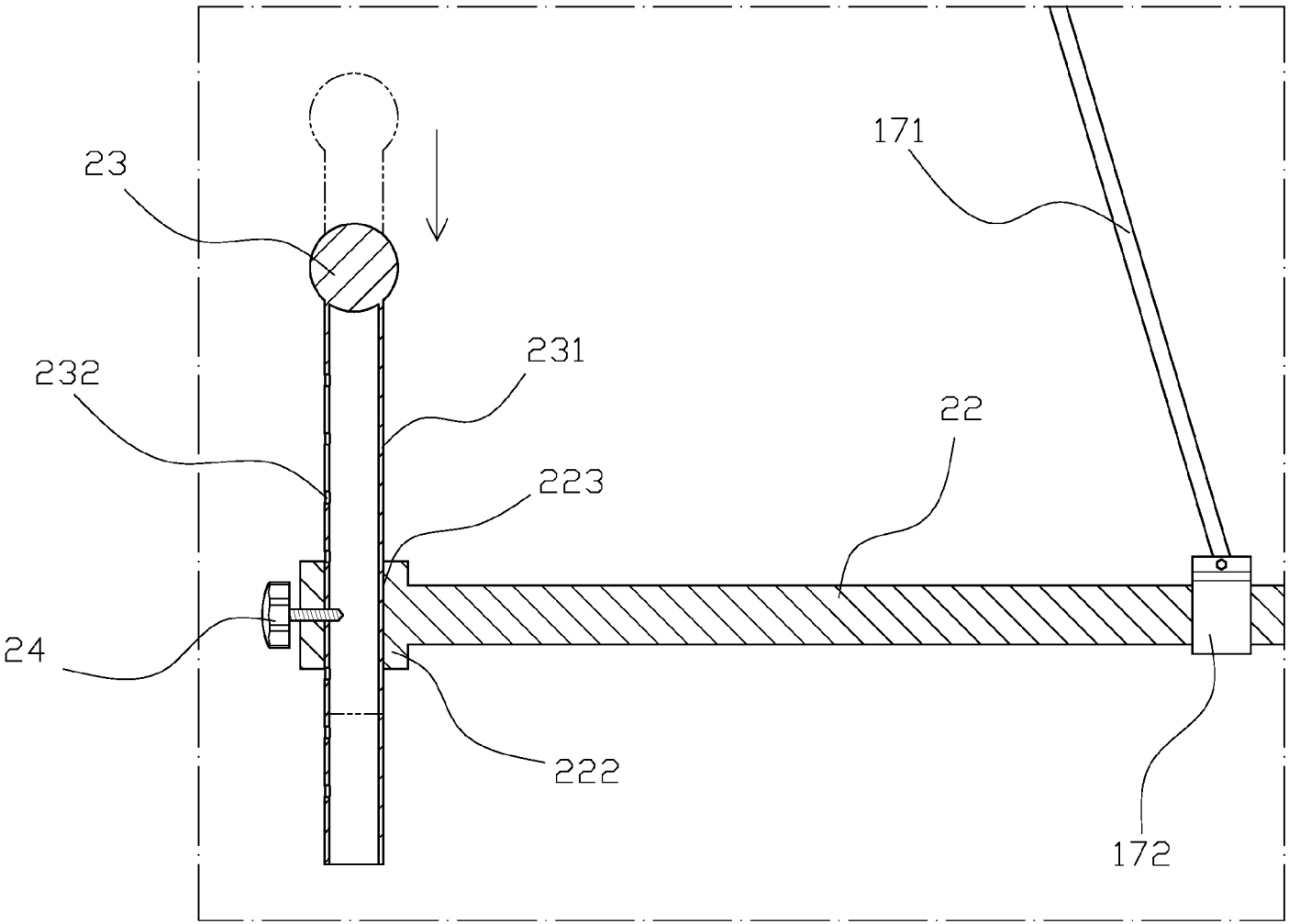
FIG. 5 is a detailed cross-sectional view of a connection between a handle and an adjusting block according to an embodiment of the present invention.
Figure 6:
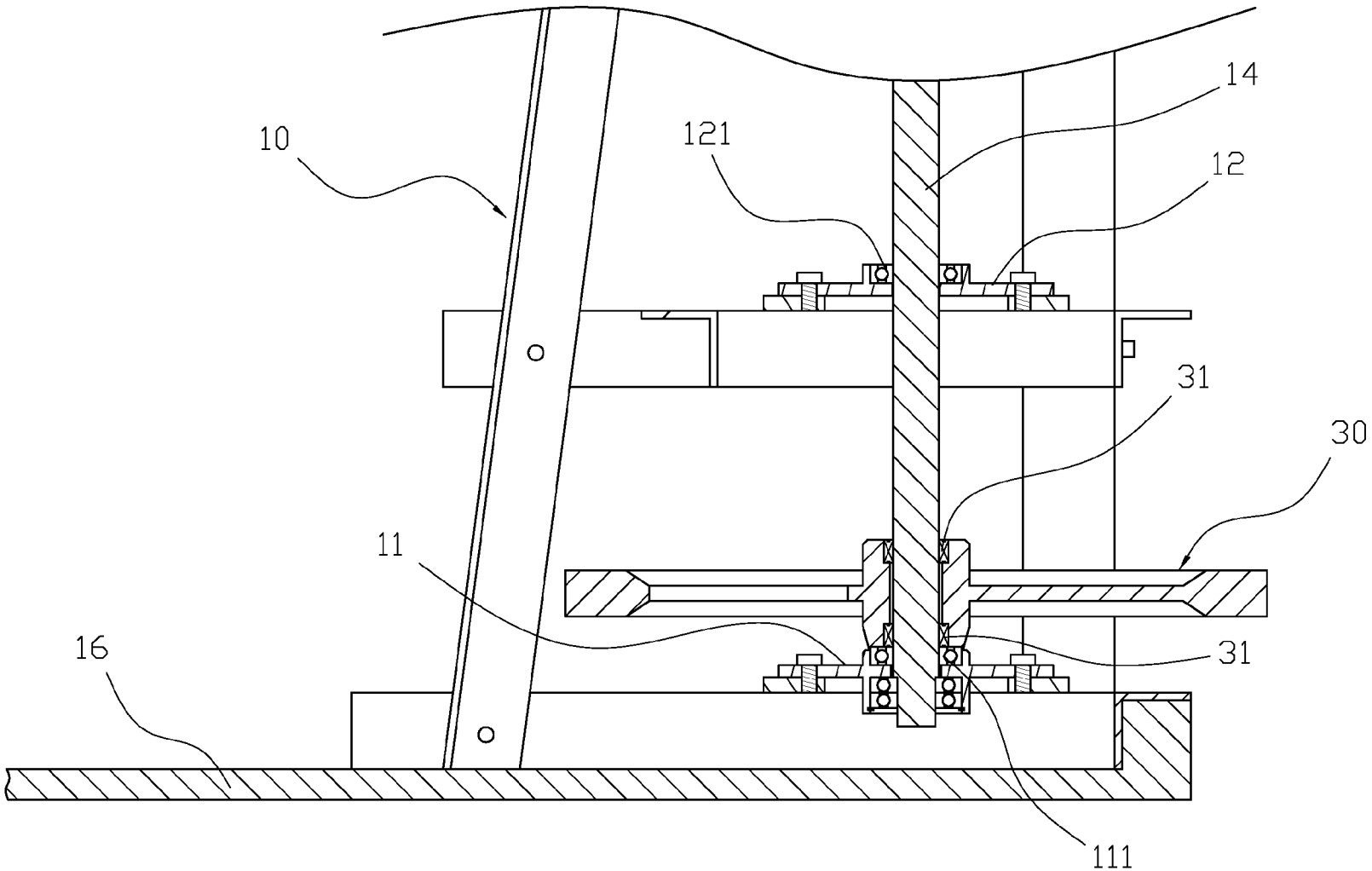
FIG. 6 is a detailed cross-sectional view of a flywheel according to an embodiment of the present invention.
Figure 7:
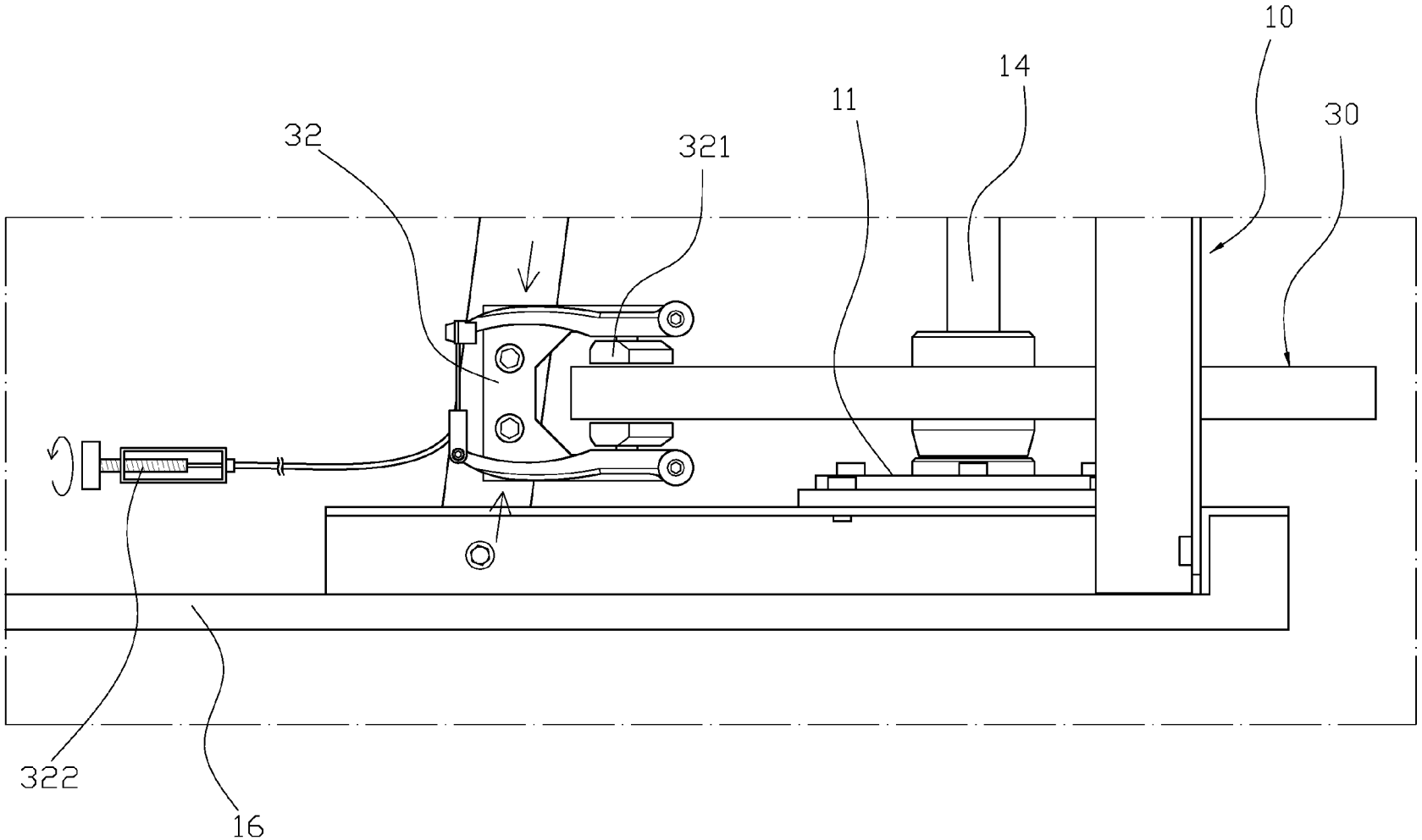
FIG. 7 is a schematic drawing showing movement of a damping device according to an embodiment of the present invention.

For structure assembly, please refer to FIG. 2 and FIG. 4. The support frame 10 is locked with the middle layer portion 12 and the upper layer portion 13, and the revolving shaft 14 is inserted through the bearings 121, 131 of the middle layer portion 12 and the upper layer portion 13, such that the revolving shaft 14 is placed vertically in the support frame 10. Furthermore, one end of the revolving shaft 14 protrudes from the upper layer portion 13 and is secured with the crank 15, and the crank 15 includes the extension bar 18 with the extended connecting portion 182. The connecting rod 21 and the driving rod 22 of the control set 20 are locked together with the screw 212, a corresponding tap 221 and a nut 213, and the driving rod 22 is secured with the nut 213. The control set 20 is pivoted to the connecting portion 182 of the extension bar 18 with a hole 211 of the connecting rod 21 such that the crank 15 and the driving rod 22 are placed parallel with each other. Moreover, the adjusting block 222 of the driving rod 22 provides the positioning aperture 223 to accept the connecting tube 231 of the handle 23, as shown in FIG. 5, and the adjusting knob 24 is secured to the adjusting block 222 using one of the through apertures 232 of the connecting tube 231 to lock the handle 23. The adjusting knob 24 can be inserted into different through apertures 232 to change the height of the handle 23. The upper layer portion 13 of the support frame 10 further includes the auxiliary arm 17, and the auxiliary arm 17 is connected to the cable 171, with a free end of the cable 171 utilizing the securing member 172 for attachment to the driving rod 22. Therefore, the auxiliary arm 17 uses the cable 171 to support the driving rod 22, and the control set 20 is combined with the support frame 10. Please refer to FIG. 3 and FIG. 6. The revolving shaft 14 is jacketed with the flywheel 30 at an end opposite from the crank 15, and the flywheel 30 is jacket with the one-way bearing 31; thus, the flywheel 30 and the revolving shaft 14 are capable of generating a one way sliding movement. The lower layer portion 11 is locked onto the bottom of the support frame 10, the bearing 111 of the lower layer portion 11 supporting the revolving shaft 14 so that the flywheel 30 is disposed between the lower layer portion 11 and the middle layer portion 12. The damping device 32 is installed on the support frame 10 adjacent to the flywheel 30, as shown in FIG. 7. The damping device 32 uses a pair of linings 321 to apply a breaking force to the flywheel 30; tightening the control button 322 controls the pressure applied by the lining 321, which creates the rotational resistance for the flywheel 30. Finally, the base board 16 is disposed at the bottom of the lower layer portion 11.

Figure 8:
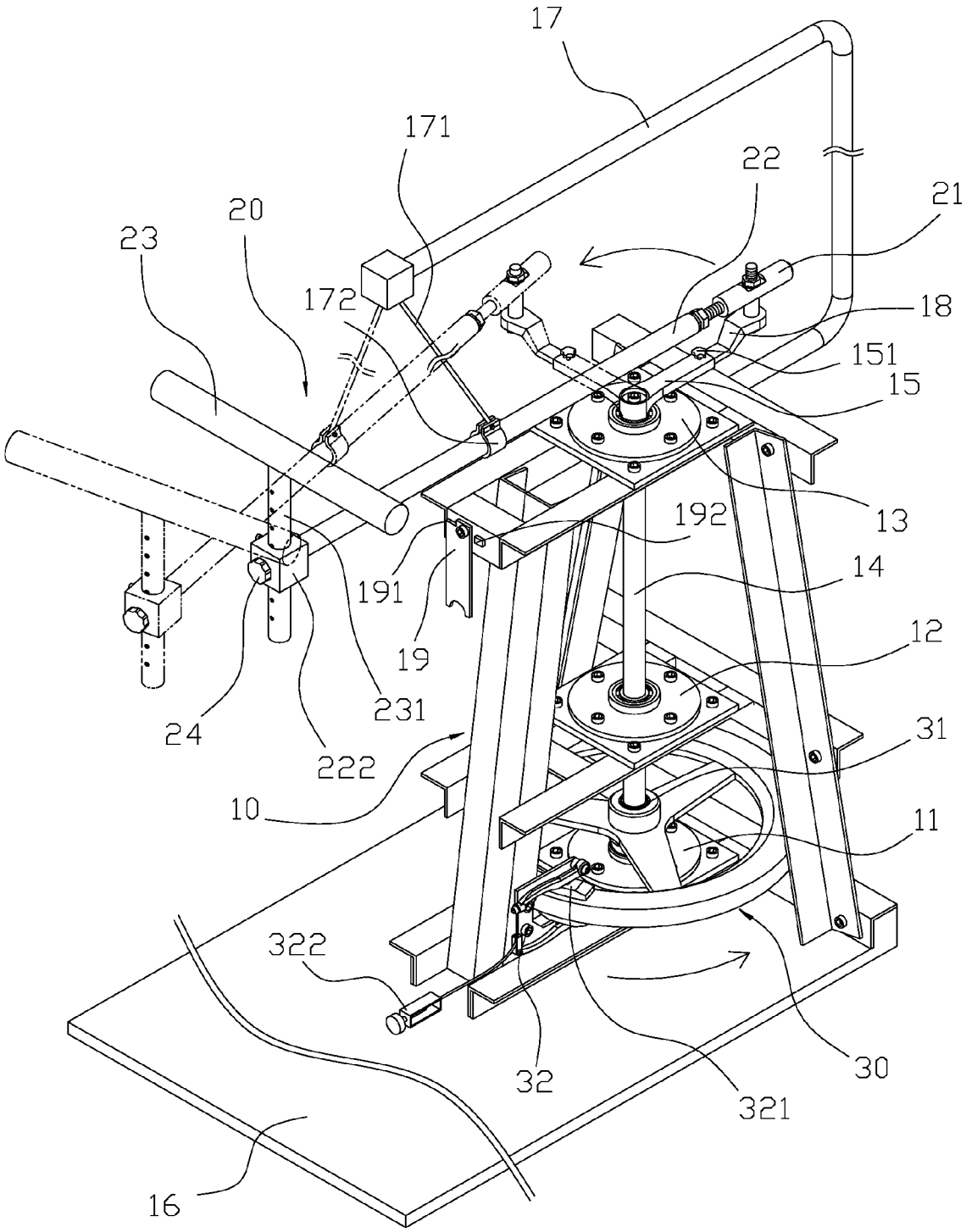
FIG. 8 is a schematic drawing of the operational movement of an embodiment of the present invention.
Figure 9:
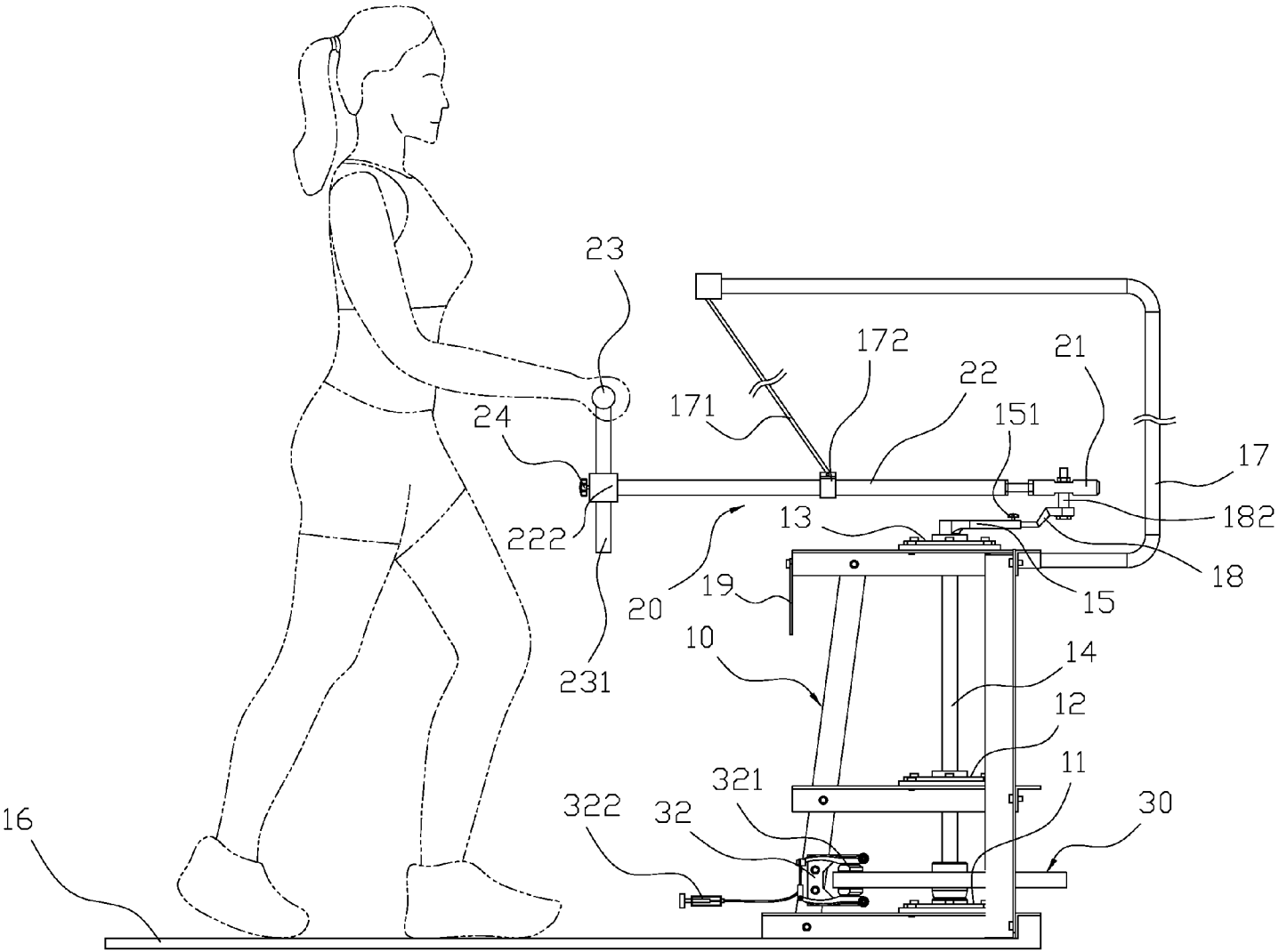
FIG. 9 is a schematic drawing illustrating operations of an embodiment of the present invention.
Figure 10:
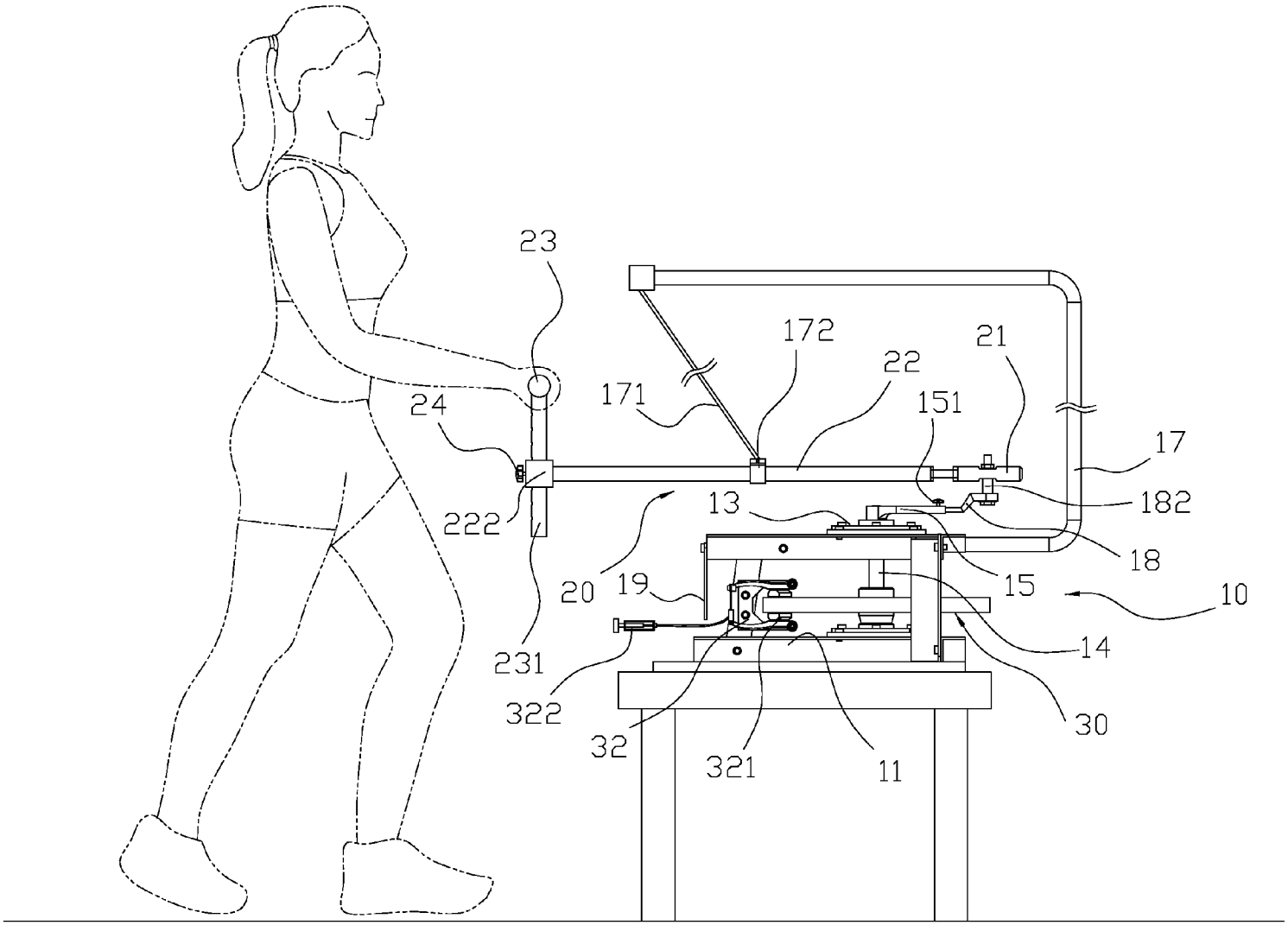
FIG. 10 is another schematic drawing illustrating operations of an embodiment of the present invention.

For operations, please refer to FIG. 8 and FIG. 9 with further reference to FIG. 2 and FIG. 3. A user holds the handle 23 of the control set 20 with both hands and stands on the base board 16 of the support frame 10. When the handle 23 is pushed to drive the driving rod 22 forward, the connecting rod 21 pivoted to the extension bar 18 of the crank 15 rotates the crank 15, and the revolving shaft 14 of the support frame 10 is also driven. Accordingly, the handle 23 gyrates with the rotational amplitude of the crank 15, and the total length of the crank 15 and the extension bar 18 is adjustable (as shown in FIG. 4) to change the rotational amplitude. However, the rotational direction of the handle 23 is identical to the locking direction of the one-way bearing 31 of the flywheel 30. Therefore, when the revolving shaft 14 drives the flywheel 30 to simultaneously rotate, the weight of the flywheel 30 provides resistance for exercise purposes. Moreover, the flywheel 30 is able to store energy to ensure a smooth rotation. Furthermore, when the user pushes and pulls the handle 23, his or her arms, shoulders, and waistline area all obtain a work out, and he or she needs to lean the body forward and backward, which provides exercise for both legs. Please refer to FIG. 10. The height of the support frame 10 can be reduced while still providing the same exercising effects. In addition, when the user stops exercising, the control set 20 and the revolving shaft 14 accordingly stop their movements, while the flywheel 30 continues rotating due to momentum, and the one-way bearing 31 ensures that the rotation of the flywheel 30 does not drive the revolving shaft 14. Therefore, the control set 20 is also not driven by the flywheel 30, which prevents the momentum of the flywheel 30 from injuring the user.

Figure 11:
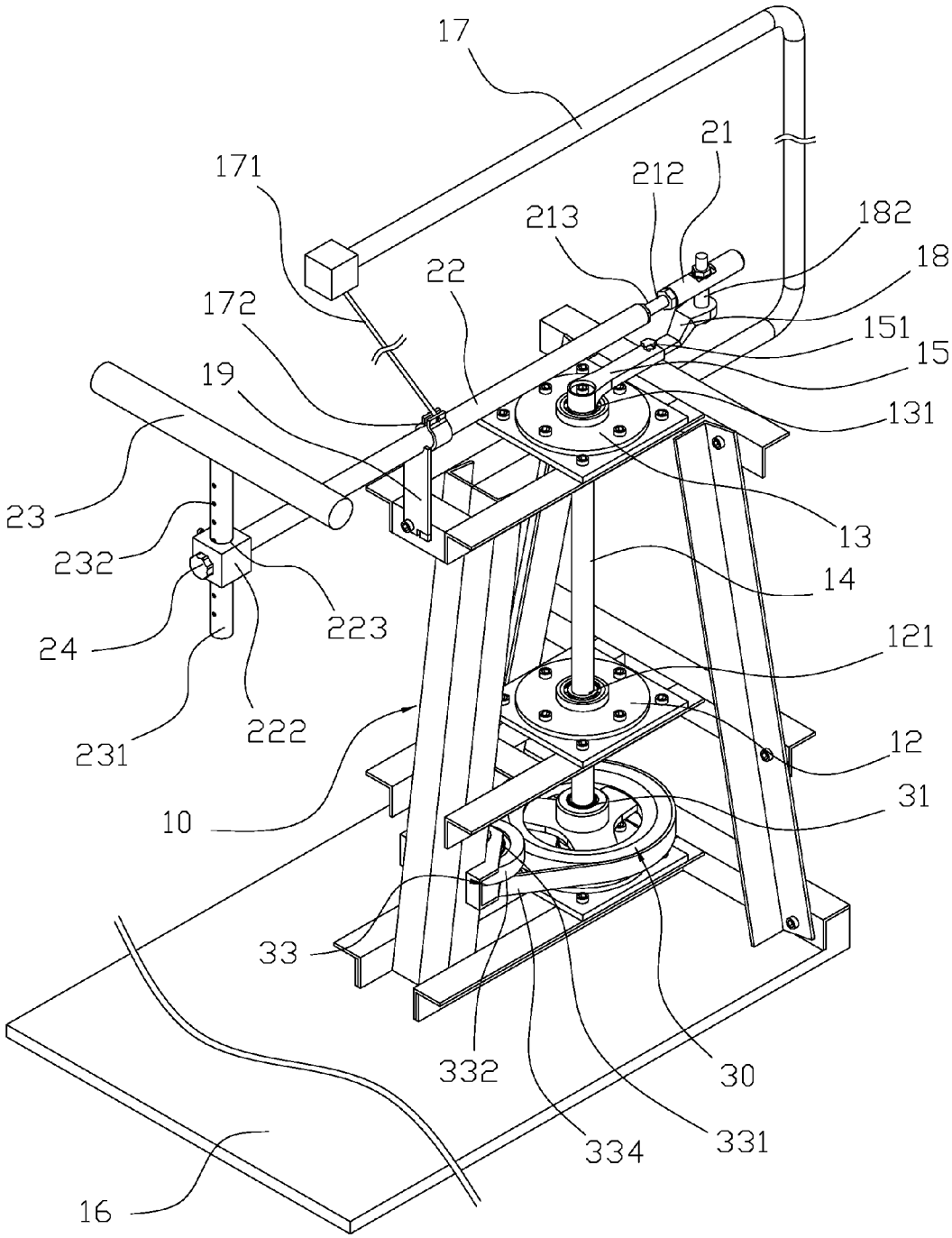
FIG. 11 is a perspective assembly view of another embodiment according to the present invention.
Figure 12:
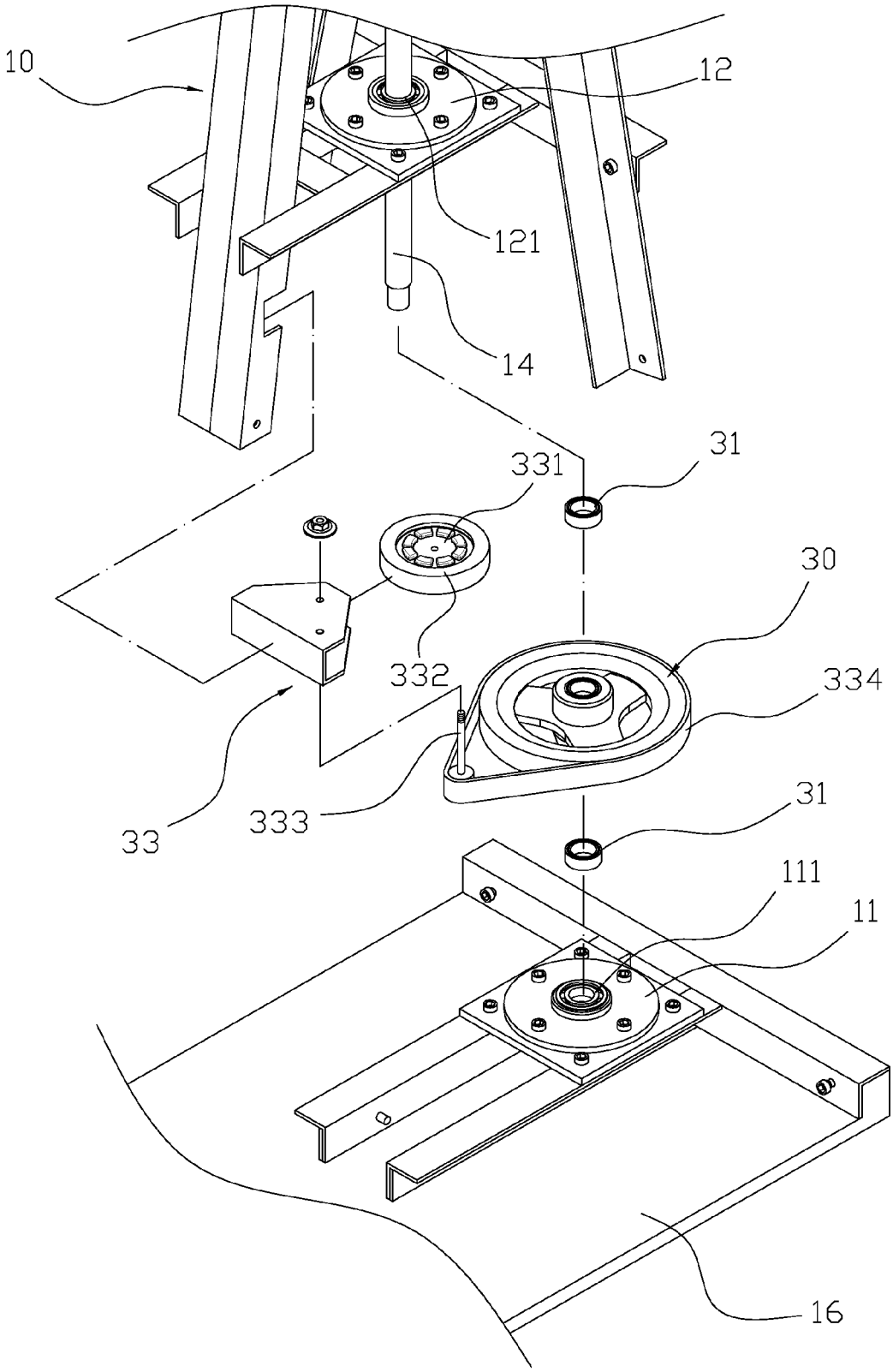
FIG. 12 is a perspective view of another embodiment according to the present invention.
Figure 13:
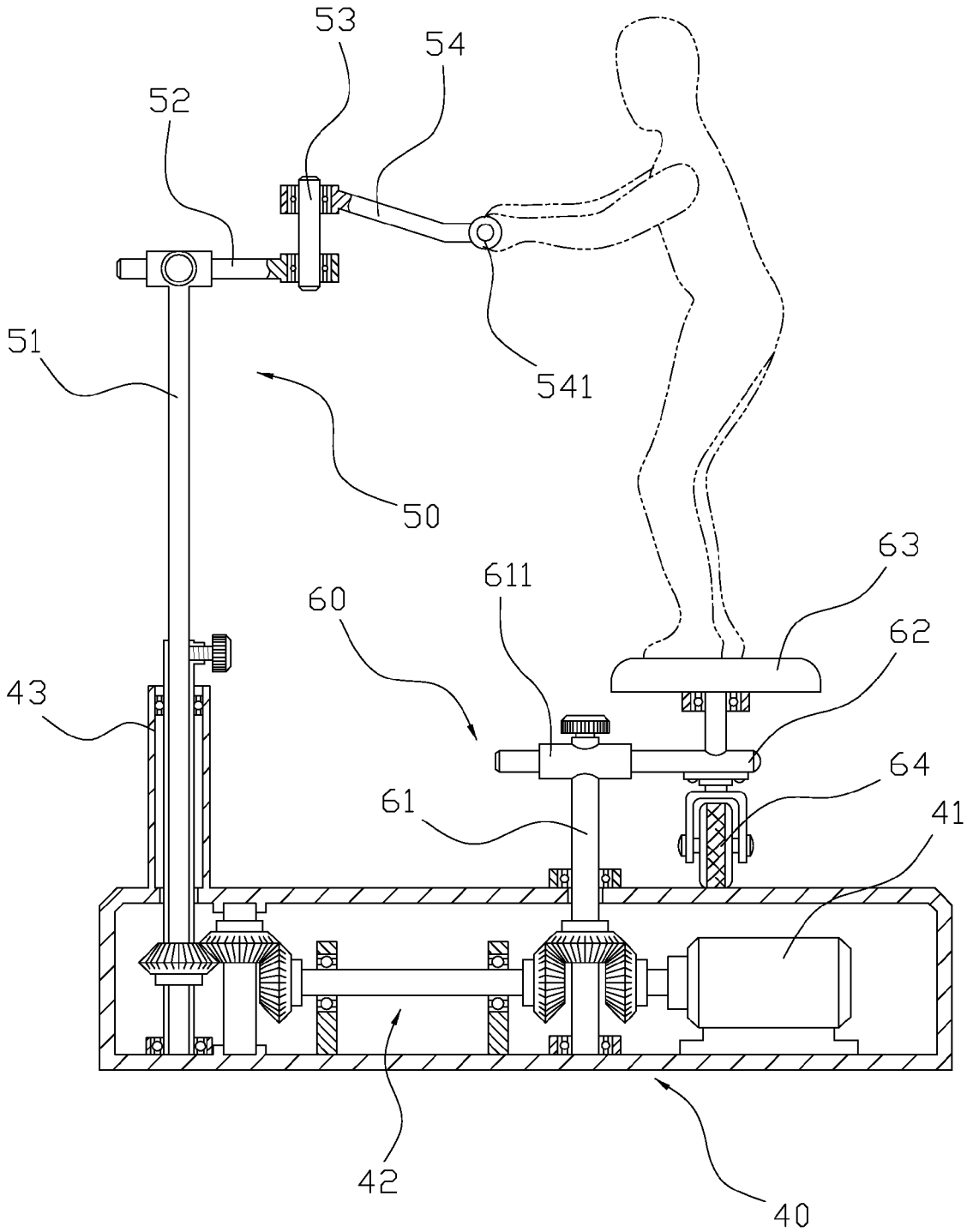
FIG. 13 PRIOR ART
FIG. 13 is a cross-sectional view of a prior art device.

For another embodiment of the present invention, please refer to FIG. 11 and FIG. 12. The support frame 10 further includes a damping device 33 disposed adjacent to the outer edge of the flywheel 30. The damping device 33 comprises a rotor 331 having a plurality of coils and a magnetic outer housing 332 installed on the outside portion of the damping device 33. An axel 333 of the rotor 331 is driven by a belt 334 wrapped around the flywheel 30. When the rotor 331 is inducted, the rotor 331 generates a magnetic field which interacts with magnetic force from the outer housing 332, and consequently with various induced currents the rotational resistance from the flywheel 30 can be changed by way of the magnetic force.

With the above-mentioned structure, following benefits may be realized: 1. Embodiments of the present invention utilize the control set 20, the crank 15 and the revolving shaft 14 to provide an upper body twisting exercise, and the flywheel 30 and the damping device 32 increase and adjust the resistance. In addition, the momentum of the flywheel 30 makes the operational movement more smooth. 2. Embodiments of the present invention need only utilize the connecting rod 21 pivoted to the extension bar 18 of the crank 15 to provide an exercise effect with a direct linkage; therefore, the operational movement can be performed silently. 3. The one-way bearing 31 is installed between the flywheel 30 and the revolving shaft 14, such that the flywheel 30 can only be driven by the control set 20 is unable to drive the control set 20 in a reversed direction.

Although the present invention has been explained in relation to its preferred embodiment, it is to be understood that many other possible modifications and variations can be made without departing from the spirit and scope of the invention as hereinafter claimed.

What is claimed is:

1. A full body twisting exercise machine comprising:

a support frame comprising a lower layer portion and an upper layer portion, a bearing respectively installed at the lower and the upper layer portions, a revolving shaft vertically disposed though both bearings, one end of the revolving shaft protruding from the upper layer portion and connected to a crank and having an extension bar, a free end of the extension bar having a connecting portion;

a control set comprising a connecting rod, a driving rod and a handle, an aperture of the connecting rod pivoted to the connecting portion of the extension bar and secured to one end of the driving rod; another end of the driving rod connected to a handle; and a flywheel disposed between the lower layer portion and the upper layer portion of the support frame and jacketing the revolving shaft; the lower layer portion of the support frame further having a damping device, wherein by pushing the handle to generate a twisting movement, the driving rod drives the revolving shaft and the flywheel to simultaneously rotate, and the flywheel and the damping device provide resistance for exercise purposes.

2. The full body twisting exercise machine as claimed in claim 1, wherein the support frame further comprises a middle layer portion between the lower and the upper layer portions, and a bearing is installed at the middle layer portion and jackets the revolving shaft to increase the rotational stability of the revolving shaft.

3. The full body twisting exercise machine as claimed in claim 1, wherein the crank further comprises a positioning knob at an end and the extension bar is inserted thereof, the extension bar providing a plurality of adjustment apertures providing different positions for the positioning knob.

4. The full body twisting exercise machine as claimed in claim 1, wherein the bottom side of the lower layer portion of the support frame further comprises a base board.

5. The full body twisting exercise machine as claimed in claim 1, wherein the connecting rod and the driving rod are locked together with a screw, a corresponding tap and a nut, and a gap between the connecting rod and the driving rod is adjustable with a threaded portion and secured with the nut.

6. A full body twisting exercise machine comprising:

a support frame comprising a lower layer portion and an upper layer portion, a bearing respectively installed at the lower and the upper layer portions, a revolving shaft vertically disposed though both bearings, one end of the revolving shaft protruding from the upper layer portion and connected to a crank and having an extension bar, a free end of the extension bar having a connecting portion;

a control set comprising a connecting rod, a driving rod and a handle, an aperture of the connecting rod pivoted to the connecting portion of the extension bar and secured to one end of the driving rod; another end of the driving rod connected to a handle; wherein the driving rod further comprises an adjusting block at an end; the adjusting block including a positioning aperture for accepting the handle, the handle being T-shaped and having an extension connecting tube inserted into the positioning aperture of the adjusting block; the connecting tube of the handle having a plurality of through holes and an adjusting knob secured onto the adjusting block, such that the adjusting knob is locked with a through hole to secure the handle and the adjusting block to provide different heights for the handle by insertion into different through holes; and a flywheel disposed between the lower layer portion and the upper layer portion of the support frame and jacketing the revolving shaft; the lower layer portion of the support frame further having a damping device, wherein by pushing the handle to generate a twisting movement, the driving rod drives the revolving shaft and the flywheel to simultaneously rotate, and the flywheel and the damping device provide resistance for exercise purposes.

7. A full body twisting exercise machine comprising:

a support frame comprising a lower layer portion and an upper layer portion, a bearing respectively installed at the lower and the upper layer portions, a revolving shaft vertically disposed though both bearings, one end of the revolving shaft protruding from the upper layer portion and connected to a crank and having an extension bar, a free end of the extension bar having a connecting portion;

a control set comprising a connecting rod, a driving rod and a handle, an aperture of the connecting rod pivoted to the connecting portion of the extension bar and secured to one end of the driving rod; another end of the driving rod connected to a handle; and a flywheel disposed between the lower layer portion and the upper layer portion of the support frame and jacketing the revolving shaft; the lower layer portion of the support frame further having a damping device, wherein by pushing the handle to generate a twisting movement, the driving rod drives the revolving shaft and the flywheel to simultaneously rotate, and the flywheel and the damping device provide resistance for exercise purposes;

wherein the upper layer portion is connected to an auxiliary arm, the auxiliary arm is bent above the control set and one free end of the auxiliary arm is connected to a cable attached to a securing member by the other end, and the securing member is secured onto the driving rod.

8. A full body twisting exercise machine comprising:

a support frame comprising a lower layer portion and an upper layer portion, a bearing respectively installed at the lower and the upper layer portions, a revolving shaft vertically disposed though both bearings, one end of the revolving shaft protruding from the upper layer portion and connected to a crank and having an extension bar, a free end of the extension bar having a connecting portion;

a control set comprising a connecting rod, a driving rod and a handle, an aperture of the connecting rod pivoted to the connecting portion of the extension bar and secured to one end of the driving rod; another end of the driving rod connected to a handle; and a flywheel disposed between the lower layer portion and the upper layer portion of the support frame and jacketing the revolving shaft; the lower layer portion of the support frame further having a damping device, wherein by pushing the handle to generate a twisting movement, the driving rod drives the revolving shaft and the flywheel to simultaneously rotate, and the flywheel and the damping device provide resistance for exercise purposes;

wherein the upper layer portion further comprises a pivotably coupled brace, the brace comprising a notch adapted to engage with a corresponding protrusion on the upper layer portion;

wherein the brace supports the driving rod.

9. The full body twisting exercise machine as claimed in claim 1, wherein the damping device utilizes at least a lining that engages with an outer edge of the flywheel, and the damping device is connected to a control button for adjusting a pressure of the lining against the outer edge of the flywheel.

10. A full body twisting exercise machine comprising:

a support frame comprising a lower layer portion and an upper layer portion, a bearing respectively installed at the lower and the upper layer portions, a revolving shaft vertically disposed though both bearings, one end of the revolving shaft protruding from the upper layer portion and connected to a crank and having an extension bar, a free end of the extension bar having a connecting portion;

a control set comprising a connecting rod, a driving rod and a handle, an aperture of the connecting rod pivoted to the connecting portion of the extension bar and secured to one end of the driving rod; another end of the driving rod connected to a handle; and a flywheel disposed between the lower layer portion and the upper layer portion of the support frame and jacketing the revolving shaft; the lower layer portion of the support frame further having a damping device, wherein by pushing the handle to generate a twisting movement, the driving rod drives the revolving shaft and the flywheel to simultaneously rotate, and the flywheel and the damping device provide resistance for exercise purposes;

wherein the damping device comprises a rotor having a plurality of coils, and a magnetic outer housing is installed at an outside of the damping device; wherein an axel of the rotor is driven by a belt engaged with the flywheel.

11. The full body twisting exercise machine as claimed in claim 1, wherein a one way bearing is installed at a connection of the flywheel and the revolving shaft.

* * * * *